United States Patent [19]

Lillibridge et al.

[11] 3,976,304

[45] Aug. 24, 1976

[54] SKI BOOT SCRAPER

[76] Inventors: Christopher B. Lillibridge, 29 Ridgewood Drive, Norwich, Conn. 06360; Alfred H. Lotring, R.D. No. 1 Lord's Point, Stonington, Conn. 06378

[22] Filed: June 6, 1975

[21] Appl. No.: 584,612

[52] U.S. Cl. ..... 280/11.37 E; 15/237

[51] Int. Cl.[2] ..... A63C 11/00; A63C 11/18

[58] Field of Search ..... 280/11.13 T, 11.37 T, 280/11.37 R, 11.37 E; 15/236 R, 237, 238, 239, 240, 241, 215

[56] References Cited

UNITED STATES PATENTS

| | | | |
|---|---|---|---|
| 455,194 | 6/1891 | Frost | 15/237 |
| 771,809 | 10/1904 | Burnell | 15/215 |
| 3,284,091 | 11/1966 | Spier | 280/11.13 T |
| 3,295,860 | 1/1967 | Von Hoven | 280/11.13 T |
| 3,357,714 | 12/1967 | Kuehn | 280/11.37 E |
| 3,826,518 | 7/1974 | Hennig | 280/11.13 T |
| D33,485 | 10/1900 | Taft | 15/237 |

*Primary Examiner*—M. H. Wood, Jr.
*Assistant Examiner*—David M. Mitchell

[57] ABSTRACT

A device adapted to be mounted on, or integral with, the upper surface of a snow ski for the purpose of removing ice, snow, mud, and the like from the bottom of a skier's boot prior to insertion of the boot into the binding. The device is generally in the shape of a disk, a ring, a polygon, or variations of those shapes so as to present a maximum scraping surface to the boot regardless of the direction of approach of the boot relative to the ski. At the same time, a smaller lower surface is provided for mounting on the ski with a minimal effect on the flex of the ski, and the device has preferably a low profile and a beveled edge or ramp so as to prevent crossed skis from becoming interlocked either between the scraper and the ski or between the scraper and the boot binding.

20 Claims, 24 Drawing Figures

SKI BOOT SCRAPER

BACKGROUND OF THE INVENTION

1. Field of Invention

This invention relates generally to snow skis and, more particularly, to improved boot scrapers for use with snow skis.

2. Description of the Prior Art.

In recent years, snow skiing has become one of the world's fastest growing sports. Each winter, increasing numbers of enthusiasts are drawn to the ski slopes. In keeping with their enthusiasm, amateurs and experts alike are continuously seeking newer and improved equipment to further improve their skills and extend their performance and enjoyment.

One difficulty plaguing skiers concerns the condition of the bottom or under surface of a skier's boot. It is essential that the under surface of the boot be clean and free of foreign material such as snow, ice, mud, and the like prior to insertion of the boot into the binding of the ski. Unless the under surface of the boot is clean, the skier will not be positioned firmly on the upper surface of the ski. Furthermore, the boot might otherwise, undesirably, become fixed to the ski by freezing of the snow between the boot and the ski or by reason of the adhering quality of the mud. However, with a clean under surface, the boot can be readily and properly seated within the ski binding and, in this condition, the boot can be easily locked to and unlocked from the ski and, more importantly, can be readily released from the binding under emergency conditions.

Until recently, a skier was forced to rely on hand-held scraping devices or whatever natural scraping surface might be available as he or she was preparing to ski. More recently, however, the art has developed to the point at which scrapers have been actually mounted on the upper surface of the ski so that they would be readily available to a skier. However, the known constructions could present a number of serious drawbacks that are overcome by the present invention. At this point it is important to explain, and it should be stressed, that for purposes of both safety and performance, a ski should be permitted to flex about axes generally perpendicular to its longitudinal axis. The primary drawback of earlier designs resided in the large size either of the surface area contacting the ski or of the length of the device in contact with the ski. By reason of their large size or length, these known devices could seriously reduce the capability of the ski to flex in the proper manner with a resultant reduction of both safety and performance.

An additional drawback of the known scrapers resided in the fact that they provided only limited scraping angles of the ski boot relative to the ski; that is, unless the ski was properly oriented relative to the ski boot, the scraper was of minimum value in achieving its intended purpose. Furthermore, even a design that offered a somewhat improved effectiveness with respect to relative orientation of the boot and ski could become rapidly clogged with ice, snow, mud, and the like, rendering it useless until it was itself cleaned by the skier. Additionally, some scrapers had sharp edges that could permit crossed skis to become interlocked or could result in injury to a skier who accidentally fell on the scraper.

3. Summary of the Invention.

It was with these various drawbacks in mind that the present invention was conceived. The invention, then, relates generally to a device adapted to be mounted on the upper surface of a snow ski for the purpose of removing ice, snow, mud, and the like from the bottom of a skier's boot prior to insertion of the boot into the binding. The device is generally of low profile and in the shape of a disk, a ring, a polygon, or variations of those shapes. It is provided with a broad upper platform for scraping the boot, a smaller lower surface for mounting on the ski, and it may include a pedestal connecting the upper platform and the lower surface. The scraper as disclosed may be mounted on a ski by means of mechanical fasteners, or by means of a suitable adhesive. New skis may be sold already incorporating the scraper, although it may also be readily mounted on old or conventional skis or may be formed integrally with a ski.

Also, the invention provides a scraper offering a maximum scraping surface while having a minimum surface in contact with the ski. Such a design assures a minimal effect on the flexibility of the ski with which it is being used.

Another feature of the invention is that it is usable regardless of the orientation of the ski.

Still another feature of the invention is its continuous availability for use, being permanently affixed to a ski.

Further features of the invention are its compactness, low cost, and ability to be fabricated from a variety of materials.

Still a further feature of the invention is its resistance to accumulation of the material being scraped from the bottom of a boot.

Yet a further feature of the invention is its low profile design which prevents crossed skis from becoming interlocked between the scraper and the ski.

Other and further features of the invention will become apparent from the following description taken in conjunction with the following drawings. It is to be understood that both the foregoing general description and the following detailed description are exemplary and explanatory but are not restrictive of the invention. The accompanying drawings, which are incorporated in and constitute a part of this invention, illustrate different embodiments of the invention and together with the description, serve to explain the principles of the invention.

DESCRIPTION OF THE PREFERRED EMBODIMENTS

Figure 1:
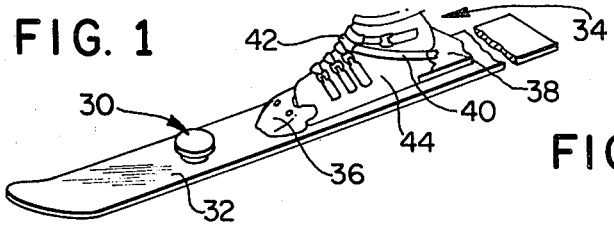
FIG. 1 is a perspective view of a snow ski utilizing the invention and illustrating the invention positioned at a location forward of the boot binding.
Figure 2:
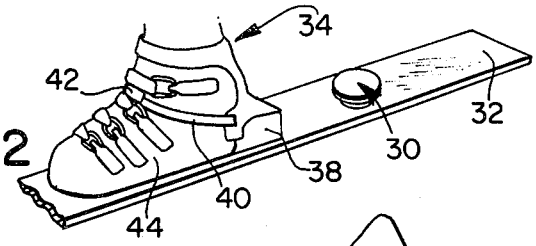
FIG. 2 is a perspective view of a portion of a snow ski utilizing the invention as illustrated in FIG. 1 but illustrating the invention positioned at a location aft of the boot binding.

Refer now to the drawings and initially to FIGS. 1 and 2 which generally illustrate the invention as it is applied to a snow ski. In FIG. 1, a scraper 30 in the form of a disk is shown mounted on an upper surface of a snow ski 32 forward of a boot binding 34. The scraper 30 is preferably of a low profile so as to prevent crossed skis from becoming interlocked between it and the ski. The boot binding 34 includes a toe receiving element 36, a heel receiving element 38 and straps 40 and 42 secured to the element 38 for extension around a ski boot 44. It will be appreciated that the description of the boot binding 34 is merely illustrative of a well known construction and forms no part of the present invention.

Referring to FIG. 2, an arrangement is shown similar to that in FIG. 1 except that, in this view, scraper 30 is mounted on the snow ski 32 at a location aft of the boot binding 34. It should be appreciated, then, that the scraper 30 may be mounted on the snow ski 32 at any reasonable location suitable to the user. One skier may prefer that the scraper 30 be located forward of the binding 34, while another skier may prefer that it be positioned aft of the binding. FIGS. 1 and 2 merely illustrate, respectively, each of these preferences.

Figure 3:
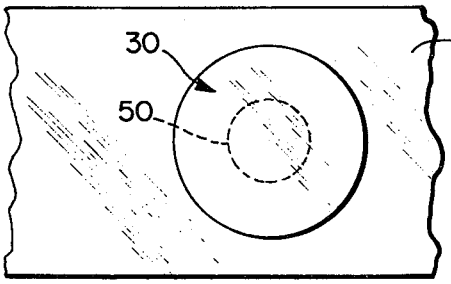
FIG. 3 is a detail top plan view of the invention illustrated in FIGS. 1 and 2 shown positioned on an upper surface of a portion of a snow ski.
Figure 4:
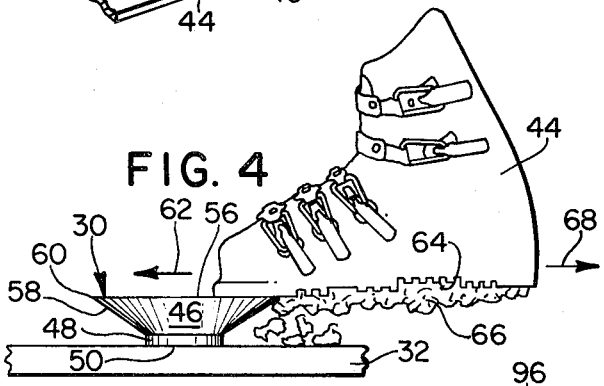
FIG. 4 is a side elevation view of the invention illustrated in FIGS. 1, 2 and 3 and showing its intended use.
Figure 4A:
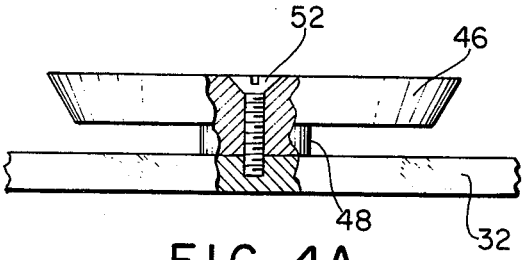
FIG. 4A is a detail side elevation view of the invention, partially cut away, illustrating one manner of fastening the invention to a ski.
Figure 4B:
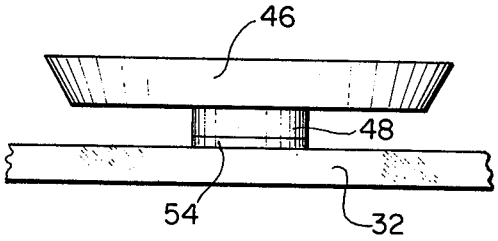
FIG. 4B is a detail side elevation view of the invention, illustrating another manner of fastening the invention to a ski.

A general description of the scraper 30 can be made by referring to FIGS. 3 and 4 which provide illustrations of the invention in greater detail. In these FIGURES, the scraper 30 is shown to include a platform 46 and a pedestal 48 positioned between the platform and an upper surface of the ski 32. A lower surface 50 of the pedestal 48 conforms to and interfaces with the upper surface of the ski for mounting the scraper 30 on the ski 32. Any suitable means may be employed for mounting the scraper on the ski. For example, one or more screws 52 (FIG. 4A) or other mechanical fastener devices may be utilized, or adhesive 54 (FIG. 4B) such as glue or epoxy or two-sided tape may be utilized, all of which are commercially available. Although the platform 46 and the pedestal 48 are generally considered herein to be of unitary construction, it is within the scope of the invention to provide the platform and pedestal in separate pieces which may be fastened together on the ski by means of such fasteners or adhesive as just described.

The platform 46 has an upper or sliding surface 56 lying in a substantially horizontal plane spaced from the first surface 50. Interposed between the lower and upper surfaces is a scraping surface 58 which intersects the upper surface 56 at a scraping edge 60 which defines the outer limits of the upper surface of the scraper 30. It is noteworthy that for purposes of the invention disclosed herein, the surface area of the lower surface 50 is smaller than that of the upper surface 56.

In FIG. 4, the ski boot 44 is shown being moved in the direction of an arrow 62 such that an under surface 64 of the boot engages the scraping edge 60 of the scraper 30. As the ski boot 44 is moved across the scraper 30, material 66 such as snow, ice, mud, and the like adhering to the under surface of the boot engages the scraping surface 58. With the boot 44 in contact with the upper surface 56, the scraping edge 60 first contacts the material 66 and, acting as a wedge, removes the material from the under surface 64. The material 66 may advance along the scraping surface 58 until it no longer adheres to the scraper and falls onto the upper surface of the ski. In a similar manner, the boot 44 may be moved in the direction of another arrow 68 so that the heel of the boot first engages the scraping edge 60 on the opposite side of the scraper 30. Or alternatively, the boot may be moved in a lateral direction to achieve the same result.

Figure 7:
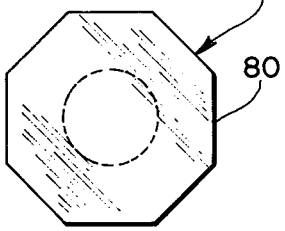
FIGS. 5 through 11 are top plan views, respectively, of various shapes which the invention may assume.
Figure 6:
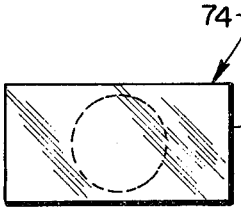
Figure 5:
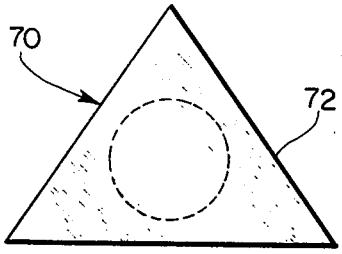

FIG. 5 illustrates a scraper 70 which generally resembles the scraper 30 but in which the outer limits of its upper surface at a scraping edge 72 define a triangle while FIG. 6 illustrates a scraper 74 having a scraping edge 76 in the shape of a rectangle. FIG. 7 represents a further modification of the scraper 30. In this instance, a scraper 78 has a scraping edge 80 in the shape of an octagon. FIGS. 5, 6, and 7, then, are merely representative of a large number of polygonal shapes, regular or irregular, which the scraping edge for the scraper 30 may assume.

Figure 8:
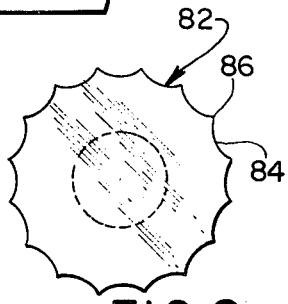

FIG. 8 illustrates a scraper 82 having a scraping edge 84 which is of a further modified shape. Specifically, in place of the straight lines which define the scraping edges 72, 76, and 80, the scraper 82 is provided with a scraping edge comprising a successive series of concave surfaces 84 alternating with apices 86.

Figure 9:
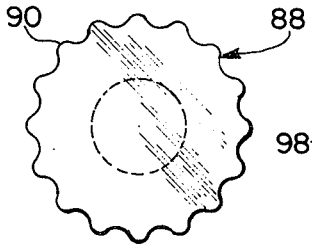

A scraper 88 is illustrated in FIG. 9 as having a scraping edge 90 having a contour which is generally similar to the shape of a closed and continuous sine wave.

Figure 10:
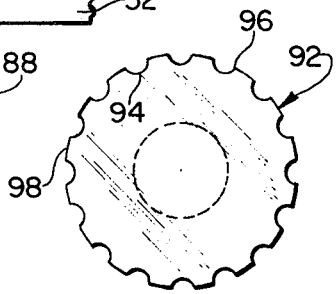

In FIG. 10, a scraper 92 has a scraping edge having a contour which is a continuous enclosed alternating series, successively, of concave curves 94, apices 96 and convex curves 98.

Figure 11:
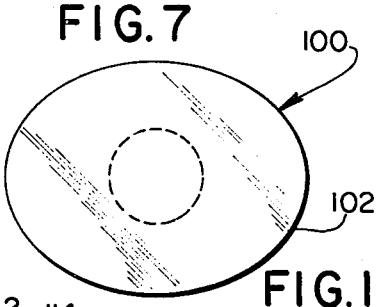

FIG. 11 illustrates a scraper 100 having a scraping edge 102 with an outer contour in the shape of an ellipse.

With respect to each of the shapes sown in FIGS. 5 through 11, the basic concept is similar to that provided by the scraper 30 initially as described. Specifically, the concept is to provide a compact scraper in which the magnitude of the scraping surface presented to the under surface 64 of the boot 44 is a maximum and the magnitude of the actual interface between the lower surface 50 and the upper surface of the ski 32 is a minimum. The reasoning behind this concept is to provide an effective scraper adapted for mounting on a ski while having a minimum effect on the flexibility of the ski. Thus, while the lower surface 50 (FIG. 3) and the corresponding unnumbered surfaces indicated by dotted lines in each of the FIGS. 5 through 11 are shown as circles, indeed, they can assume any desired shape or contour, the only restriction for purposes of the present invention being that the area of the lower surface 50 be smaller than that of the upper surface 56. Furthermore, each of the scrapers illustrated in FIGS. 5 through 11 can be utilized in substantially the same manner as the scraper 30.

Figure 12:
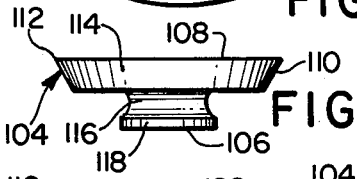
FIGS. 12, 13 and 14 are side elevation views of further embodiments of the invention.
Figure 13:
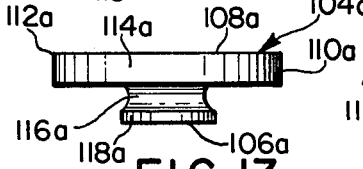
Figure 14:
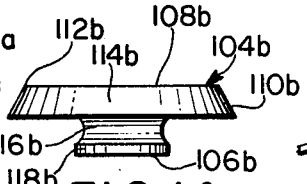

FIGS. 12, 13 and 14 illustrate variations from the shape of the scraper 30 in side elevation as illustrated in FIG. 4. Specifically, in FIG. 12, a scraper 104 has a lower surface 106 and a upper surface 108 with a scraping surface 110 interposed between the lower and upper surfaces and beveled inwardly and downwardly from a scraping edge 112. A platform 114 is supported on a pedestal 116 which is integral with and terminates in a base 118 and, specifically, at the lower surface 106. In FIG. 13, a scraper 104*a* is illustrated having a lower surface 106*a* and an upper surface 108*a* with a scraping surface 110*a* interposed between the lower and upper surfaces and substantially perpendicular to the upper surface 108*a*. The scraping surface 110*a* intersects the upper surface 108*a* at a scraping edge 112*a*. A platform 114*a* is supported on a pedestal 116*a* which is intregal with and terminates in a base 118*a* and, specifically, at the lower surface 106*a*. In FIG. 14, a scraper 104*b* is illustrated having a lower surface 106*b* and an upper surface 108*b* with a scraping surface 110*b* interposed between the lower and upper surfaces and beveled outwardly and downwardly from a scraping edge 112*b*. A platform 114*b* is supported on a pedestal 116*b* which is intregal with and terminates in a base 118*b* and, specifically, at the lower surface 106*b*.

Figure 15:
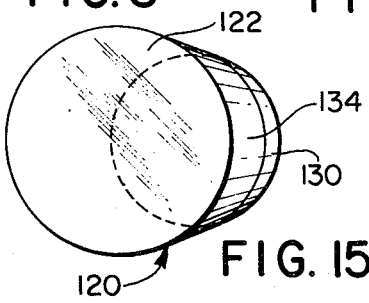
FIG. 15 is a top plan view of another embodiment of the invention, depicting an upper platform offset from a base.
Figure 16:
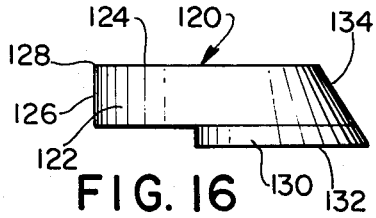
FIG. 16 is a side elevation view of the embodiment illustrated in FIG. 15.

FIGS. 15 and 16 illustrate another embodiment of the scraper 30. In this instance, a scraper 120 is provided with a platform 122 having an upper surface 124 and a scraping surface 126, with these two surfaces intersecting in a scraping edge 128. The scraper 120 is also provided with a pedestal 130 which terminates at a lower surface 132. The scraper 120 differs from all of the other scrapers described herein by reason of the fact that a vertical axis of the platform 122 is spaced from a vertical axis of the pedestal 130, the two axes being substantially parallel to one another. The scraper 120 is further provided with a ramp or beveled surface 134 extending from the lower surface 132 to the upper surface 124. With this configuration, the scraper 120 is mounted on the upper surface of the ski 32 in such a fashion (not shown) that the ramp 134 faces the boot binding 34 regardless of whether the scraper is placed forward or aft of the binding. In this manner, skis which may become crossed will not become engaged or interlocked between the binding 44 and the scraper but slide up the ramp 134 and off the scraper.

Figure 17:
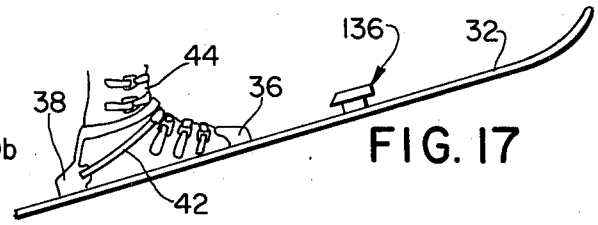
FIG. 17 is a side elevation view of a forward portion of a snow ski illustrating still another embodiment of the invention.
Figure 18:
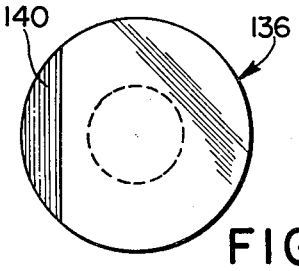
FIG. 18 is a top plan view of the embodiment illustrated in FIG. 17.
Figure 19:
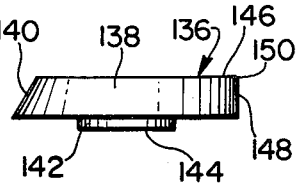
FIG. 19 is a side elevation view of the embodiment illustrated in FIGS. 17 and 18.

Still another variation of the invention is illustrated in FIGS. 17, 18, and 19. In this instance, a scraper 136 is shown similarly mounted on the upper surface of the ski 32. The unique feature of the scraper 136 is that a platform 138 is provided with a beveled surface 140 which faces the boot binding (FIG. 17) and serves substantially the same purpose as the ramp 134 of the embodiment shown in FIGS. 15 and 16. As with each of the other embodiments disclosed, the scraper 136 includes a pedestal 142 teminating at a lower surface 144 for mounting on the ski 32, an upper surface 146, a scraping surface 148, and a scraping edge 150 at the intersection of the surfaces 144 and 146.

From the standpoint of safety, it is preferable that the invention provide a ramp or beveled surface as disclosed in the embodiments of FIGS. 15 through 19 for preventing the mutual engagement of crossed skis. Another expedient to overcome any such difficulty would be achieved by assuring a design in which the distance between the surfaces 50 and 56 (FIG. 4) is less than the thickness of the ski 32.

Figure 21:
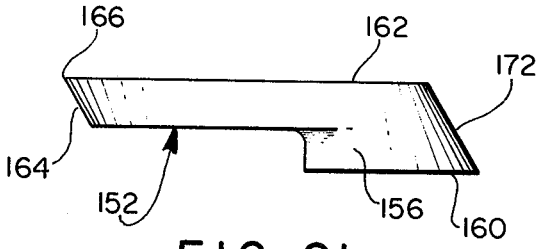
FIG. 21 is a side elevation view of the embodiment illustrated in FIG. 20.
Figure 22:
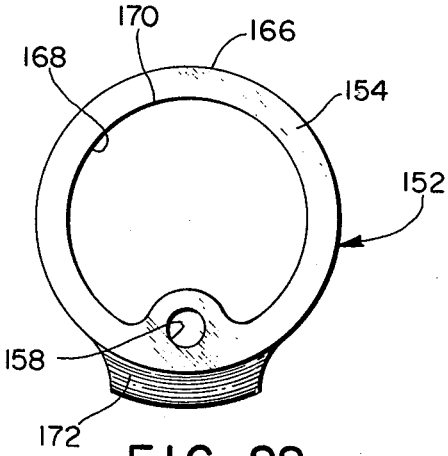
FIG. 22 is a top plan view of the embodiment illustrated in FIGS. 20 and 21.
Figure 20:
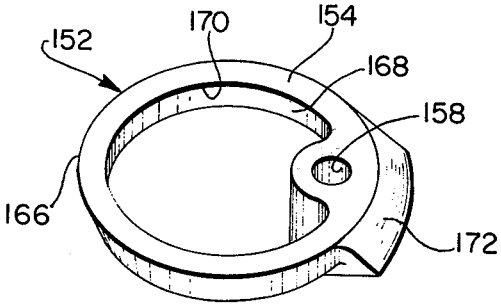
FIG. 20 is a perspective view of yet another, and preferred, embodiment of the invention.

Yet another embodiment of the invention is illustrated in FIGS. 20, 21, and 22 and can be considered a preferred embodiment of the invention. In this instance, a scraper 152 is provided with a platform 154 generally in the shape of a ring supported on an offset pedestal 156. A hole 158 suitably formed through the pedestal 156 serves to receive a suitable fastener (not shown) for mounting the scraper on the upper surface of the ski. As with the other embodiments, the scraper 152 has a lower surface 160 to interface with the upper surface of the ski and an upper surface 162. An outside scraping surface 164 may be beveled downwardly and inwardly relative to the scraper from an outer scraping edge 166. A similar inside scraping surface 168 may similarly extend downwardly from an inner scraping edge 170. A beveled surface or ramp 172 extends downwardly and outwardly from the upper surface 162 to the lower surface 160. As with the embodiments illustrated in FIGS. 15 through 19, the ramp 172 is preferably positioned to face the boot binding 34 to prevent crossed skis from becoming interlocked. By reason of the ring shaped configuration of this embodiment, it will be appreciated that in use, the scraper 152 simultaneously presents both scraping edges 166 and 170 to the under surface 64 of the boot 44 for even more rapid and effective cleaning of the boot than is possible with the other embodiments.

The invention thus disclosed provides a device adapted to be mounted on the upper surface of a snow ski for the stated purpose of removing ice, snow, mud, and other material from the bottom of a skier's boot. As disclosed, the invention presents a maximum scraping surface to a boot while requiring a minimum contacting surface with the ski. The design prevents a substantial degree of build-up or accumulation of material on itself and permits a boot to be scraped without regard to the particular orientation of the ski.

The invention in its broader aspects is not limited to the specific details shown and described; departures may be made from such details without departing from the principles of the invention and without sacrificing its chief advantages.

What is claimed is:

1. Apparatus usable with a snow ski for removing material from the bottom of a ski boot comprising:

a body adapted to be mounted on the upper surface of a ski;

said body having a lower surface conformable to the upper surface of the ski, an upper surface lying in a substantially horizontal plane spaced from said lower surface, and a scraping surface interposed between said lower and upper surfaces, said scraping surface intersecting said upper surface at a scraping edge, and said lower surface having a surface area smaller than said upper surface.

2. Apparatus as set forth in claim 1 including means for mounting said body on the upper surface of the ski.

3. Apparatus as set forth in claim 1 wherein said mounting means includes a mechanical fastener device connecting said body to the ski.

4. Apparatus as set forth in claim 1 wherein said mounting means includes adhesive for attaching said lower surface to the ski.

5. Apparatus as set forth in claim 1 wherein the outer limits of said upper surface at said scraping edge define a circle.

6. Apparatus as set forth in claim 1 wherein the outer limits of said upper surface at said scraping edge define a polygon.

7. Apparatus as set forth in claim 1 wherein the outer limits of said upper surface at said scraping edge define a continuous and closed alternating series of concave curves and apices.

8. Apparatus as set forth in claim 1 wherein the outer limits of said upper surface at said scraping edge define a continuous and closed sine wave.

9. Apparatus as set forth in claim 1 wherein the outer limits of said upper surface at said scraping edge define a continuous and closed alternating series of concave curves, apices, and convex curves.

10. Apparatus as set forth in claim 1 wherein the outer limits of said upper surface at said scraping edge define an ellipse.

11. Apparatus as set forth in claim 1 wherein said scraping surface is beveled relative to said upper surface and lies in a plane which forms an acute angle with respect to said upper surface.

12. Apparatus as set forth in claim 1 wherein said scraping surface is substantially perpendicular to said upper surface.

13. Apparatus as set forth in claim 1 wherein said scraping surface is beveled relative to said upper surface and lies in a plane which forms an obtuse angle with respect to said upper surface.

14. Apparatus as set forth in claim 1 wherein a major portion of said scraping surface is substantially perpendicular to said upper surface and a minor portion thereof is beveled relative to said upper surface and lies in a plane which forms an obtuse angle with respect to said upper surface.

15. Apparatus as set forth in claim 1 wherein said body is integral with the ski.

16. Apparatus as set forth in claim 1 wherein said lower and upper surfaces, respectively, have first and second centrally located axes perpendicular thereto, said first and second axes being spaced apart and substantially parallel to one another, and wherein said lower surface intersects said scraping surface at a lower edge, a portion of said scraping surface nearest said first axis being a beveled surface extending downwardly and in a direction away from said first and second axes between said upper and lower surfaces.

17. Apparatus usable with a snow ski for removing material from the bottom of a ski boot comprising:

a body adapted to be mounted on the upper surface of a ski;

said body including a ring shaped platform and a pedestal integral with said platform for mounting said body on the ski;

said pedestal having a lower surface conformable to the upper surface of the ski;

said platform having an upper surface lying in a substantially horizontal plane spaced from said lower surface and an outside scraping surface interposed between said lower and upper surfaces on an exterior portion thereof and an inside scraping surface interposed between said lower and upper surfaces on an interior portion thereof, said outside scraping surface intersecting said upper surface at an outside scraping edge, and said inside scraping surface intersecting said upper surface at an inside scraping edge.

18. Apparatus as set forth in claim 17 including means for mounting said body on the upper surface of the ski.

19. Apparatus as set forth in claim 17 wherein said lower and upper surfaces, respectively, have first and second centrally located axes perpendicular thereto, said first and second axes being spaced apart and substantially parallel to one another, and wherein said lower surface intersects said outside scraping surface at a lower edge, a portion of said outside scraping surface nearest said first axis being a beveled surface extending downwardly and in a direction away from said first and second axes between said upper and lower surfaces.

20. Apparatus as set forth in claim 19 wherein said outside scraping surface in regions spaced from said beveled surface lies in a plane which forms an acute angle with respect to said upper surface.

* * * * *